US005463974A

United States Patent [19]

Seeder

[11] Patent Number: 5,463,974

[45] Date of Patent: Nov. 7, 1995

[54] MOUNT FOR A FLAG, DISPLAY AND THE LIKE

[76] Inventor: Lewis Seeder, 476 Greenglade Ave., Worthington, Ohio 43085

[21] Appl. No.: 245,976

[22] Filed: May 19, 1994

[51] Int. Cl.[6] ..... G09F 17/00

[52] U.S. Cl. ..... 116/173; 116/28 R; 40/591; 248/539

[58] Field of Search ..... 40/591, 592; 116/173, 116/174, 175, 28 R; 248/31.2, 539

[56] References Cited

U.S. PATENT DOCUMENTS

| | | | |
|---|---|---|---|
| D. 149,639 | 5/1948 | Helehan . | |
| D. 313,214 | 12/1990 | Phillips et al. . | |
| 1,597,266 | 9/1926 | Dearman . | |
| 1,857,774 | 5/1932 | Wickman . | |
| 1,876,351 | 9/1932 | Shirley . | |
| 2,398,748 | 4/1946 | Lange et al. | 248/539 |
| 2,405,701 | 8/1946 | Lange | 248/539 |
| 2,534,117 | 12/1950 | Flick | 116/173 X |
| 2,646,240 | 7/1953 | Anderson . | |
| 3,127,868 | 4/1964 | Guthrie . | |
| 3,241,516 | 3/1966 | Hopkins . | |
| 3,286,386 | 11/1966 | Glantz | 40/592 |
| 3,762,360 | 10/1973 | Hawes . | |
| 4,015,557 | 4/1977 | Schulein . | |
| 4,123,030 | 10/1978 | Johansson | 248/539 X |
| 4,163,426 | 8/1979 | O'Neill . | |
| 4,519,153 | 5/1985 | Moon et al. . | |
| 4,650,147 | 3/1987 | Griffin . | |
| 4,679,523 | 7/1987 | Orero et al. . | |
| 4,976,410 | 12/1990 | Tomaiuolo . | |
| 4,986,209 | 1/1991 | Spica . | |
| 5,042,418 | 8/1991 | Hoover et al. . | |
| 5,233,938 | 8/1993 | Lalo . | |
| 5,305,704 | 4/1994 | Olaniyan | 116/28 R |
| 5,363,792 | 11/1994 | Petechik | 116/28 R |

FOREIGN PATENT DOCUMENTS

| | | | |
|---|---|---|---|
| 1105660 | 12/1955 | France | 40/591 |

*Primary Examiner*—William A. Cuchlinski, Jr.
*Assistant Examiner*—Willie Morris Worth
*Attorney, Agent, or Firm*—Trexler, Bushnell, Giangiorgi & Blackstone, Ltd.

[57] ABSTRACT

A mount for displaying an item, such as a flag, message, slogan and the like, on a surface, such as a hood or trunk of an automobile includes a clip portion and an integrally formed wall having a shaped cavity therein. The clip has a first leg integrally formed with a second leg. The shaped cavity accepts the item therein, and projects outwardly from the first leg of the clip. The cavity extends through the first leg of the clip so that the item may be released from the mount upon removal of the mount from the surface.

20 Claims, 2 Drawing Sheets

MOUNT FOR A FLAG, DISPLAY AND THE LIKE

BACKGROUND OF THE INVENTION

This invention is generally directed to a mount that securely holds and displays a flag, display and the like. More particularly, the invention contemplates a mount which is attached to a surface of an automobile, such as a trunk or a hood, and displays a flag, message or the like while the automobile is in transit or parked.

Flags and the like are commonly displayed on vehicles to denote occasions, such as a parade or a motorcade, or to convey messages, such as advertising, slogan, affiliations, etc. These flags and message conveyors are attached to the vehicle by a mounting device.

One example of a prior art flag mount is disclosed in U.S. Pat. No. 5,233,938 to Lalo. Lalo discloses a flag mount which is connected to a vertically adjustable window of a vehicle. The mount includes a U-shaped clip which seats over the top edge of the window. The clip includes a socket in which a flag is mounted such that the flag projects upwardly when the mount is attached to the window. This type of prior art flag mount presents a disadvantage in that the window cannot be rolled down, particularly while the car is in transit, without the possibility of the flag dislodging from the window.

Another example of a prior art flag mount is one that utilizes a suction cup which attaches a flag mast to a trunk or hood of a car. While this type of flag mount works effectively when the car is stationary, it tends to fall off of the car while the car is in transit due to the torsional and bending movements which are generated by winds forces. Moreover, suction cups sometimes scratch or mar the surface to which they are mounted.

In order to allow a purchaser of a mount to display different flags or message conveyors with the mount, the flag or message conveyor should be removable from the mount. The removability of the flag or message conveyor should preferably be done in a manner which is not obvious to a passerby in order to prevent the passerby from being tempted to remove the flag or message conveyor.

An example of a flag and mount that tends to tempt a passerby to take the flag is disclosed in U.S. Pat. No. 5,233,938 to Lalo. Lalo discloses a flag having spring legs which extend into a socket in the mount. A portion of the spring legs project outwardly of the mount through apertures in the mount. To remove the flag from the mount, a user pinches the legs so that they move back through the apertures and pulls the flag out of the mount. With this configuration, it is obvious to a passerby that the flag is easily removed.

The present invention is intended to overcome or minimize all of these problems, as well as to present several other improvements in flag or message conveyor mounts.

OBJECTS AND SUMMARY OF THE INVENTION

A general object of the present invention is to provide a mount for a flag, message conveyor or the like that can be mounted on a surface.

An object of the present invention is to provide a mount that is mounted on a trunk or a hood of an automobile and is used while the automobile is parked or in transit.

Another object of the present invention is to provide a mount that allows a flag or message conveyor to be easily removed by a user and replaced with another flag or message conveyor.

A further object of the present invention is to provide a mount that allows a flag or message conveyor to be easily removed while making the removal of the flag or message conveyor unobvious to a passerby.

Briefly, and in accordance with the foregoing, the present invention discloses a mount for displaying an item, such as a flag, message, slogan or the like, on a surface, such as a hood or trunk of an automobile. The mount includes a clip portion and an integrally formed, solid, wall extending therefrom. The clip has first and second legs which are integrally formed with each other. The wall includes a shaped cavity therein for accepting the item therein. The cavity extends through the first leg of the clip so that the item may be released from the mount.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
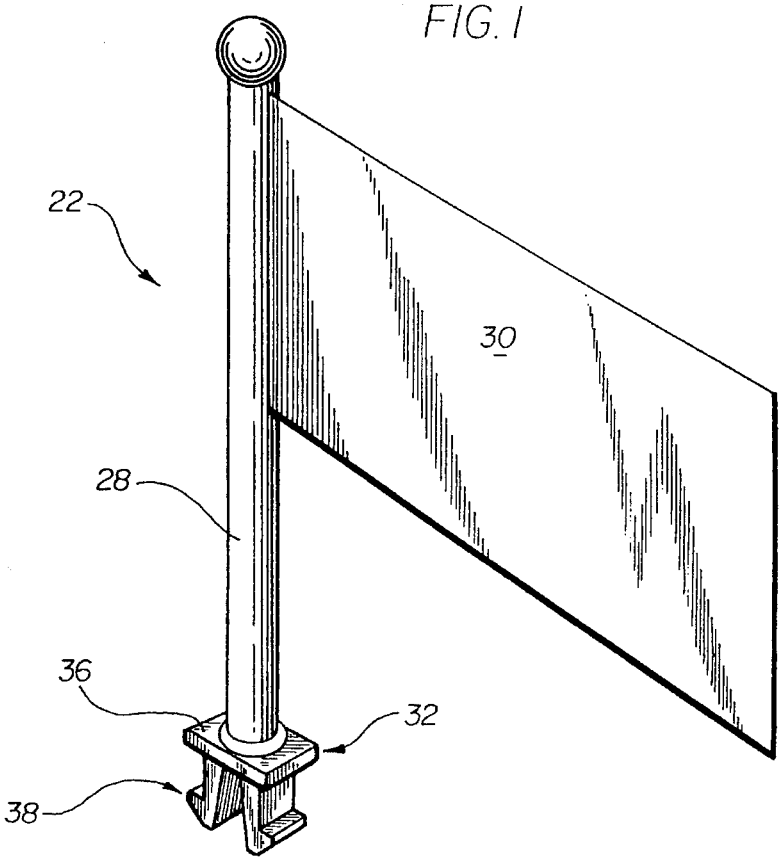
FIG. 1 is a perspective view of a flag which can be attached to a mount as shown in FIGS. 2 or 5.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
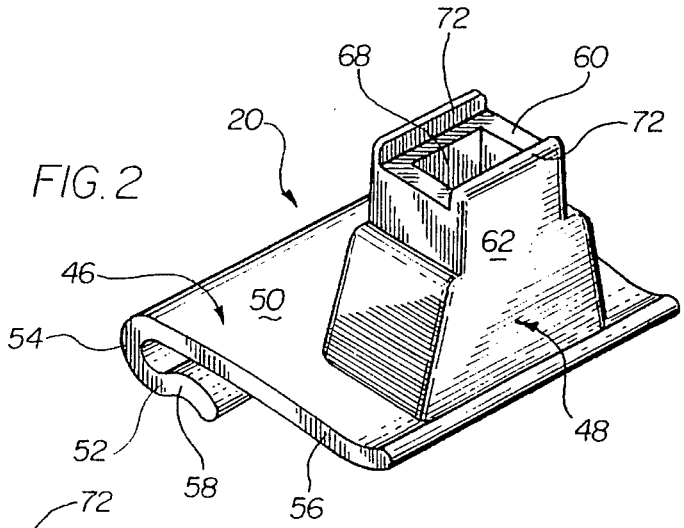
FIG. 2 is a mount which incorporates the features of a first embodiment of the invention, which mounts a flag, such as the one shown in FIG. 1, or a message conveyor, such as one shown in FIG. 6.
Figure 3:
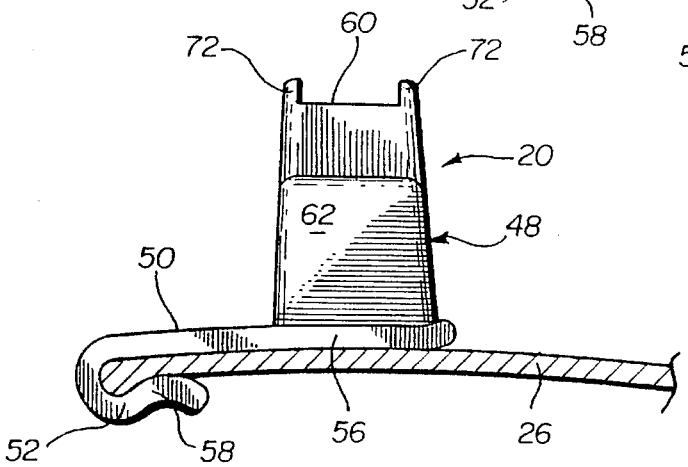
FIG. 3 is an end view of the mount shown in FIG. 2 attached to a horizontal surface.
Figure 5:
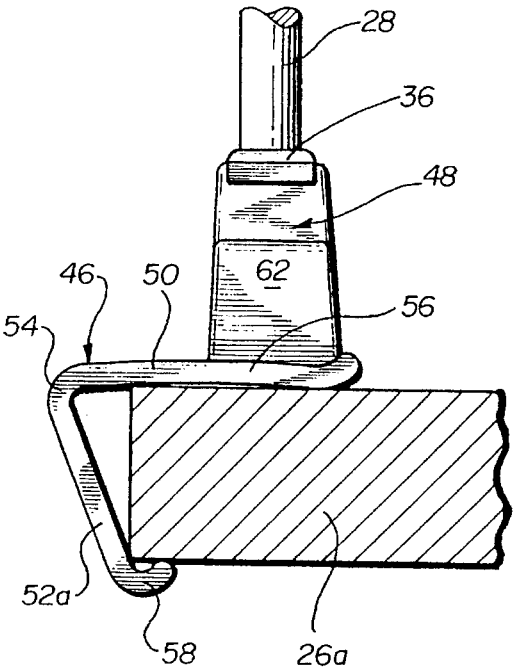
FIG. 5 is an end view of a mount, attached to a horizontal surface, which incorporates the features of a second embodiment of the invention, which mounts a flag, such as the one shown in FIG. 1, or a message conveyor, such as one shown in FIG. 6.
Figure 6:
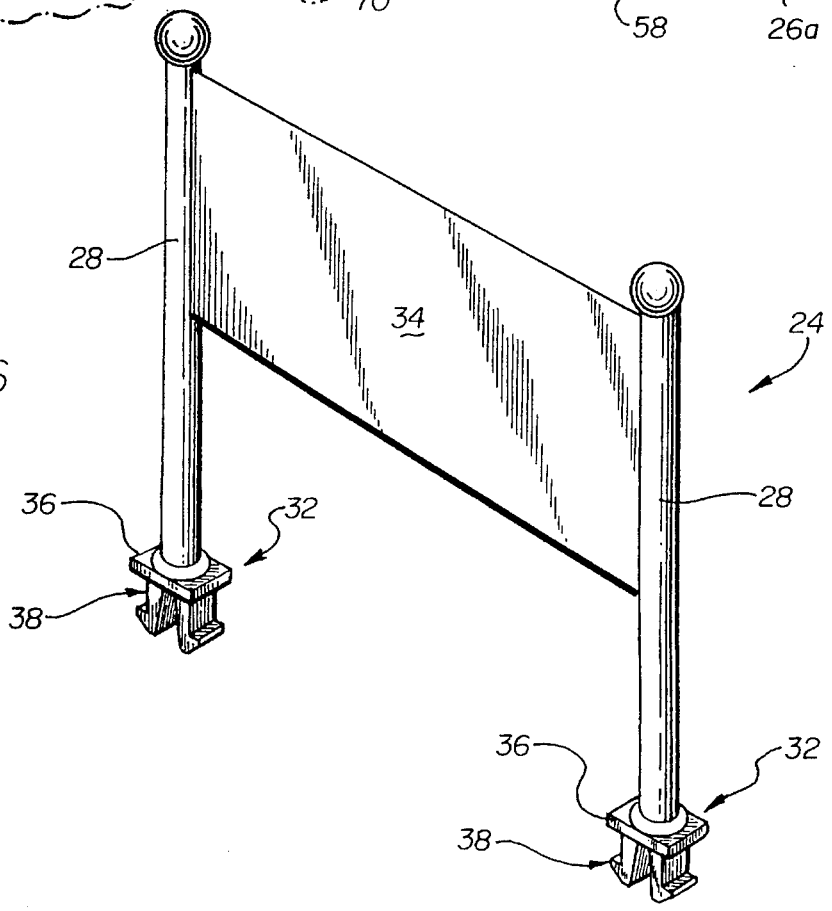
FIG. 6 is a perspective view of a message conveyor which can be attached to mounts as shown in FIGS. 2 or 5.

In FIGS. 2 and 3, a first embodiment of a mount 20 that includes the features of the present invention is shown. In FIG. 5, a second embodiment of a mount 20*a* that includes the features of the present invention is shown. A flag device 22, as shown in FIG. 1, or a message conveying device 24, as shown in FIG. 6, is attached to and securely held by the mount.

The embodiment of the mount 20, shown in FIGS. 2 and 3, is described first. Thereafter, the second embodiment of the mount 20*a*, as shown in FIG. 5, is described. The below description refers to the embodiment shown in FIG. 2 but has equal application to the embodiment shown in FIG. 5 except for the differences noted hereinbelow. The components of the mount 20*a* that are different than the mount 20 are denoted by an "a" following the numeral.

The flag device 22 and the message conveying device 24 are used for displaying items. For example, the American flag, an advertisement, a slogan, an affiliation and the like may be displayed.

The mount 20 of the present invention attaches to a surface 26 of an automobile. The mount 20 is preferably attached to a horizontal surface, such as a trunk or hood of an automobile. When the mount 20 is attached to the trunk or the hood, instead of to the window as the prior art discloses, the flag device 22 or message conveying device 24 may be displayed while allowing the window to be rolled down when the automobile is in transit. It is within the scope of the invention, however, that the mount 20 may be attached to a vertical surface, such as a fender, a window or a vertically extending lip of a trunk.

The flag device 22, as shown in FIG. 1, includes a mast 28 having upper and lower ends, a flag 30 at the upper end of the mast 28 and a member 32 for attaching the flag device 22 to the mount 20 at the lower end of the mast 28. The flag device 22 may be formed as one integral piece made of a suitable material, such as plastic. Alternatively, the mast 22 and attaching member 32 may be formed as one integral piece made of a suitable material, such as plastic, and the flag 30 formed separately from a suitable material, such as cloth, and attached to the upper end of the mast 28 by known methods.

The message conveyor device 24, as illustrated in FIG. 6, is similar to the flag device 22 shown in FIG. 1 but includes two masts 28, each having an upper and lower end, and a panel 34 at the upper end of each mast 28 sandwiched therebetween. A member 32 for attaching the message conveying device 24 to a mount 20 is at to the bottom end of each mast 28. The message conveying device 24 may be formed as one integral piece made of a suitable material, such as plastic or alternatively, the device 24 may be made by components.

As shown in FIGS. 2, 3 and 5, the mast 28 used in the present invention is straight along its length. It is to be noted that it is within the scope of the invention that the mast 28 include curves, bends or loops along its length.

The attaching member 32 used with the present invention includes a platform 36 and resilient spring legs 38 which extend downwardly from the platform 36. Each spring leg 38 has a latch portion 40 at its free end. The latch portion 40 includes an upper, outwardly projecting, horizontal face 42 and a sloping lower face 44.

The mount 20 of the present invention generally includes a clip portion 46 and a holder body portion 48 formed integrally therewith. The mount 20 is made of a suitable resilient material, such as plastic and may be made by conventional methods, such as molding.

The clip portion 46 shown in FIG. 2 includes a first leg 50 integrally formed with a second leg 52 by a U-shaped bight portion 54. When the mount 20 is placed on the surface, for example horizontal surface 26, to which it is to be attached, the first leg 50 sits proximate to and generally abutting one side of the surface 26 and the second leg 52 sits proximate to and generally abuts the opposite side of the surface 26.

The first leg 50 is generally flat but may include a sloping curve 56 along its length which urges the first leg 50 inwardly towards the second leg 52. The second leg 52 is shaped to include a curve 58 along its length which urges the second leg 52 inwardly towards the first leg 50.

The distance between the legs 50, 52 is less than the width of the surface, for example 26, to which the mount 20 is to be attached. The mount 20 is made of a resilient material so as to allow the legs 50, 52 to flex slightly away from each other as the surface 26 is placed between the legs 50, 52 while allowing the legs 50, 52 to press up against the opposing faces of the surface 26 and generally conform thereto when the mount 20 is mounted onto the surface 26. The curves 56, 58 of the legs 50, 52 cause the clip portion 46 to securely grip the surface 26.

The holder body 48 to which the flag device 22 or message conveyor device 24 is attached, is formed by a top wall 60 and an outer side wall 62 which are integrally formed with the first leg 50. The side wall 62 projects generally perpendicularly to the first leg 50 and is solid along its perimeter for reasons described hereinbelow.

Figure 4:
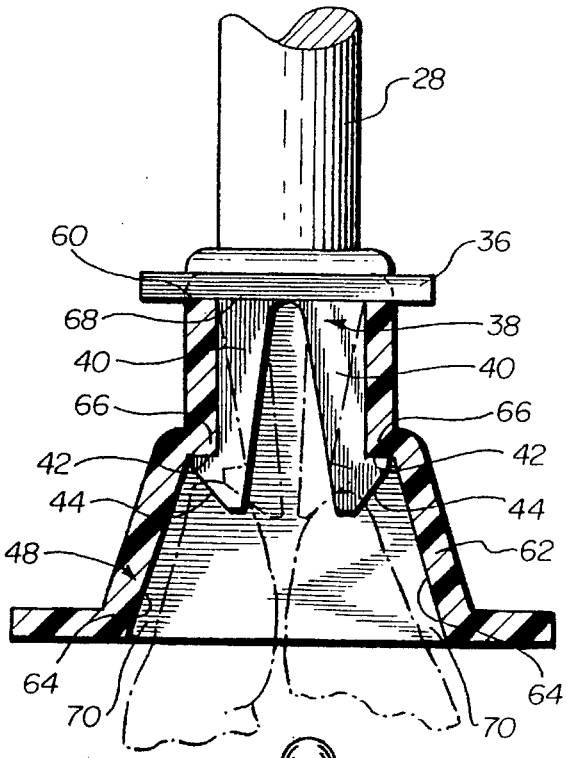
FIG. 4 is a cross-sectional view of the mount of FIGS. 3 or 5 with a flag or message conveyor attached thereto and shown in phantom, fingers releasing the flag or message conveyor from the mount.

The holder body 48 has a shaped cavity or socket 64, as best illustrated in FIG. 4, therein. The cavity 64 includes shoulders 66 along its length for securely holding the attaching member 32 of the flag device 22 or message conveyor device 24 therein as described herein. An opening or aperture 68 is formed in the top wall 60 so as to provide a passageway for the attaching member 32 and mast 28 of the flag device 22 or message conveyor device 24 to pass into the cavity 64. The cavity 64 extends through the first leg 50 of the clip portion 46 to form an opening or aperture 70 in the first leg 50.

To attach the flag device 22 or message conveying device 24 to the mount 20, the spring legs 38 are inserted through the opening 68 and into the cavity 64. When the resilient spring legs 38 are being inserted into the cavity 64, the spring legs 38 flex inwardly and slide along the interior of the side wall 62. Once the spring legs 38 are fully inserted, the resilient spring legs 38 move outwardly and back to their original position with the upper, outwardly projecting, horizontal face 42 of the latch portion 40 abutting the underside of the shoulder 66 of the cavity 64 to securely hold the flag device 22 or message conveying device 24 within the holder body 48.

When the mount 20 and attached flag device 22 or message conveying device 24 are mounted on a surface, such as 26, the aperture 70 is hidden from view. To remove the flag device 22 or message conveying device 24 from the mount 20, the mount 20 is removed from the surface, for example 26, to which it is attached so that a user may have access to the aperture 70 formed in the first leg 50. A user inserts his or her fingers through the aperture 70 in the first leg 50 and into the cavity 64. The fingers of the user grasp the sloping lower faces 44 of each spring leg 38 and then the user squeezes the spring legs 38 together to cause the spring legs 38 to flex inwardly. The user pushes the spring legs 38 out of the holder body portion 48 to release the flag device 22 or message conveying device 24.

Since the side wall 62 of the holder body 48 is solid and the flag device 22 or message conveying device 24 can only be released through the underside of the first leg 50 of the clip portion 46 after the mount 20 has been removed from the surface 26, when the mount 20 is attached to a surface 46 the flag device 22 or message conveying device 24 appears from its outward appearance to a passerby to be unremovable from the holder body 48. With this novel configuration, it is not readily apparent to a passerby as to how to release the flag device 22 or message conveying device 24. Therefore, a passerby is not easily tempted to remove the flag device 22 or message conveying device 24.

The embodiment of the mount 20*a* shown in FIG. 5 is similar to the embodiment of the mount 20 shown in FIGS. 2 and 3 except for the difference noted hereinbelow. The second leg 52*a* of the clip portion 46 is spaced a greater distance from the first leg 50 than that which is shown in FIGS. 2 and 3 so that the clip portion 46 may grasp a wider surface, for example, horizontal surface 26*a*.

One feature of note of the above described mounts 20 and 20*a* is that the top wall 60 of the holder body 48 may include flanges 72, as clearly shown in FIG. 2, which protrude outwardly from the top wall 60 to form a seat in which the platform 36 sits when the flag device 22 or message conveying device 24 is attached to the mount 20. The mast 28 is not able to rotate due to wind forces since the flanges 72 prevent the platform 36 from rotating.

Another feature of note is that while the resilient spring legs 38 of the present invention are shown as a pair of legs which are nonrotationally locked into place due to the shape of the cavity 64, it is within the scope of the invention that other forms of resilient legs are used. For example, it is envisioned that the resilient legs may be of an annular configuration with cutouts between the individual spring legs. Alternatively, a split bead arrangement may be used. If one of these forms are used, one skilled in the art could easily modify the cavity 64 to form a circular configuration which would conform to these shapes. Since the attaching member 32 may be of an annular configuration or a split bead arrangement, the flag device 22 could easily rotate around to face the downwind direction, provided the flanges 72 are not employed, when the automobile is in transit due to the rotational forces created by the wind.

An additional feature of note is that the platform 36 may be a variety of shapes and lengths. As illustrated, the platform 36 is rectangular and seats firmly within the seat defined by the flanges 72. The platform 36 may extend beyond the length of the top wall 60, as shown in FIG. 4, or alternatively the platform 36 may be the same length as the top wall 60. Furthermore, if the holder body 48 is shaped in a circular configuration so that, for example, an annular extension spring leg form may used, the platform may be shaped to be circular to allow the flag device 22 to rotate.

While preferred embodiments of the present invention are shown and described, it is envisioned that those skilled in the art may devise various modifications of the present invention without departing from the spirit and scope of the appended claims. The invention is not intended to be limited by the foregoing disclosure.

The invention claimed is:

1. A display device in combination with a mount for supporting said display device on a surface, said mount comprising:

a first leg and a second leg, said legs being integrally formed with each other, with said first leg of said mount generally abutting a face of said surface when said mount is placed thereon;

a holder body comprising a top wall and a solid side wall integrally formed with said first leg and projecting outwardly from said first leg, said holder body having a shaped cavity therein for accepting and securely holding said display device therein, said cavity extending through said first leg and forming an aperture in said first leg, said display device being releasable from said holder body upon removal of said mount from said surface; and said display device comprising: at least one mast having opposing ends;

said mast including a connecting means at a first end of said mast for connecting said mast to the mount, said connecting means being releasably held within said shaped cavity, and a display means connected to a second end of said mast for displaying an item.

2. A combination as defined in claim 1, wherein said top wall of said holder body includes an opening therein for inserting said connecting means therethrough.

3. A combination as defined in claim 1, wherein said first leg and said second leg form a clip such that said mount is securely held on said surface when said mount is placed thereon.

4. A combination as defined in claim 1, wherein said connecting means comprises resilient legs which are releasably held within said cavity.

5. A display system comprising:

a display device and a mount;

said display device comprising: at least one mast, a connecting means on a first end of said mast for releasably connecting said mast to said mount, and a display means connected to a second end of the mast for displaying an item; and said mount comprising: a clip for connecting said mount to a surface, said clip including a first leg and a second leg, said legs being integrally formed with each other; and a holder body comprising a side wall integrally formed with said first leg and projecting generally perpendicularly to said first leg and a top wall having an aperture therein for insertion of the connecting means of said display therethrough, said holder body having a shaped cavity therein for releasably accepting said connecting means therein with said shaped cavity extending through said first leg of said clip to define an aperture, said connecting means being releasable from said holder body upon the removal of the mount from the surface.

6. An item display system as defined in claim 5, wherein said connecting means comprises resilient legs.

7. A display device in combination with a mount for supporting display device on a horizontal surface, said mount comprising:

an upper leg and a lower leg, said legs being integrally formed with each other, said upper leg of said mount being proximate to and generally abutting an upper face of said horizontal surface when said mount is placed on said horizontal surface; and a holder body comprising an upstanding wall portion integrally formed with said upper leg and projecting generally upwardly when said mount is placed on said horizontal surface, said upstanding wall portion having a shaped cavity therein for releasably accepting said display device therein, said cavity extending through said upper leg and forming an aperture in said upper leg; and said display device comprising: at least one mast having opposing ends;

a display means connected to a first end of said mast for displaying an item; and a connecting means on a second end of said mast for connecting said mast to the mount, said connecting means being releasably held within said shaped cavity and releasable upon removal of said mount from said surface.

8. A combination as defined in claim 7, wherein said holder body includes a top wall having an aperture therein for insertion of said connecting means therethrough and said upstanding wall portion is solid.

9. A combination as defined in claim 7, wherein said upstanding wall portion is solid.

10. A combination as defined in claim 7, wherein said upper leg and said lower leg form a clip such that said mount is securely held on said horizontal surface when said mount is placed thereon.

11. A combination as defined in claim 7, wherein said horizontal surface is a trunk or hood of an automobile.

12. A combination as defined in claim 7, wherein said upstanding wall portion extends perpendicular to said upper leg.

13. A display device in combination with a mount for supporting said display device on a horizontal surface, said mount comprising:

an upper leg and a lower leg, said legs being integrally formed with each other, said upper leg of said mount being proximate to and generally abutting an upper face of said horizontal surface when said mount is placed on said horizontal surface; and a holder body comprising an upstanding wall portion integrally formed with said upper leg and projecting generally upwardly when said mount is placed on said horizontal surface, said upstanding wall portion having a shaped cavity therein for releasably accepting said display device therein; and said display device comprising: at least one mast having opposing ends;

said mast including a connecting means on a first end of said mast for connecting said mast to the mount, said connecting means being releasably held within said shaped cavity, and a display means connected to a second end of said mast for displaying an item.

14. A combination as defined in claim 13, wherein said connecting means comprises resilient legs which are releasably held within said cavity.

15. A combination as defined in claim 13, wherein said holder body includes a top wall having an aperture therein for insertion of said connecting means therethrough and said upstanding wall portion is solid.

16. A combination as defined in claim 13, wherein said cavity extends through said upper leg and forms an aperture in said upper leg.

17. A combination as defined in claim 16, wherein said upstanding wall portion is solid.

18. A combination as defined in claim 13, wherein said upper leg and said lower leg form a clip such that said mount is securely held on said horizontal surface when said mount is placed thereon.

19. A combination as defined in claim 13, wherein said horizontal surface is a trunk or hood of an automobile.

20. A combination as defined in claim 13, wherein said upstanding wall portion extends perpendicular to said upper leg.

* * * * *